US011479449B2

(12) United States Patent
Kou et al.

(10) Patent No.: US 11,479,449 B2
(45) Date of Patent: Oct. 25, 2022

(54) VERTICAL LIFTING DEVICE AND METHOD

(71) Applicant: TAIYUAN UNIVERSITY OF TECHNOLOGY, Taiyuan (CN)

(72) Inventors: Ziming Kou, Taiyuan (CN); Guijun Gao, Taiyuan (CN); Gongjun Cui, Taiyuan (CN); Jing Zhang, Taiyuan (CN); Haiqing Wang, Taiyuan (CN); Xueliang Wei, Taiyuan (CN)

(73) Assignee: TAIYUAN UNIVERSITY OF TECHNOLOGY, Taiyuan (CN)

( * ) Notice: Subject to any disclaimer, the term of this patent is extended or adjusted under 35 U.S.C. 154(b) by 1246 days.

(21) Appl. No.: 15/764,679

(22) PCT Filed: Feb. 16, 2017

(86) PCT No.: PCT/CN2017/073733

§ 371 (c)(1),
(2) Date: Mar. 29, 2018

(87) PCT Pub. No.: WO2018/145327

PCT Pub. Date: Aug. 16, 2018

(65) Prior Publication Data

US 2020/0239288 A1 Jul. 30, 2020

(30) Foreign Application Priority Data

Feb. 13, 2017 (CN) ..... 201710076913.5

(51) Int. Cl.
*B66D 3/00* (2006.01)
*B66D 3/06* (2006.01)
(Continued)

(52) U.S. Cl.
CPC ..... *B66D 3/06* (2013.01); *B66C 5/02* (2013.01); *B66C 15/00* (2013.01); *B66C 25/00* (2013.01)

(58) Field of Classification Search
CPC ... B66D 3/06; B66D 3/08; B66D 3/24; B66D 3/26; B66D 5/16; B66D 5/28; B66D 5/30; B66C 15/02
(Continued)

(56) References Cited

U.S. PATENT DOCUMENTS 4,448,393 A * 5/1984 Habegger ..... B66D 3/006 254/254
4,456,226 A * 6/1984 Stumpmeier ..... B66D 3/006 226/162
(Continued)

FOREIGN PATENT DOCUMENTS

CA 2804544 A1 * 1/2012 ..... B66B 19/02
CN 1579916 A 2/2005
(Continued)

OTHER PUBLICATIONS

International Search Report in the international application No. PCT/CN2017/073733, dated Nov. 15, 2017.
(Continued)

*Primary Examiner* — Emmanuel M Marcelo
(74) *Attorney, Agent, or Firm* — Syncoda LLC; Feng Ma

(57) ABSTRACT

A vertical lifting device and method are provided. The vertical lifting device includes a fixed frame fixed to a foundation. A first cavity allowing passage of a lifting rope is provided in the middle of the fixed frame. A sliding frame moving horizontally on the fixed frame is arranged above the fixed frame. A second cavity allowing passage of the lifting rope is provided in the middle of the sliding frame. At least two stepping vehicles alternately lowering or lifting weights are arranged on the sliding frame and move on the sliding frame. The stepping vehicles are spaced in preset distances. The lifting rope penetrates through the stepping vehicles in sequence. Each stepping vehicle is provided with a clamping part clamping the lifting rope and a driving
(Continued)

mechanism driving the stepping vehicle to move on the sliding frame.

19 Claims, 5 Drawing Sheets

(51) Int. Cl.
*B66C 5/02* (2006.01)
*B66C 15/00* (2006.01)
*B66C 25/00* (2006.01)

(58) Field of Classification Search
USPC ..... 254/254
See application file for complete search history.

(56) References Cited

U.S. PATENT DOCUMENTS

| | | | | | |
|---|---|---|---|---|---|
| 4,615,509 | A * | 10/1986 | Biass | B66D 3/006 254/254 |
| 5,277,406 | A * | 1/1994 | Knight | B66D 1/50 114/213 |
| 5,655,754 | A * | 8/1997 | Perrier | B66D 3/02 254/254 |
| 7,918,354 | B2 | 4/2011 | Shan | |
| 8,826,841 | B2 * | 9/2014 | Moreau | B66D 3/006 114/218 |
| 2006/0243724 | A1 | 11/2006 | Shan | |

FOREIGN PATENT DOCUMENTS

| | | | | | |
|---|---|---|---|---|---|
| CN | 101417765 | A | | 4/2009 | |
| CN | 101537974 | A | | 9/2009 | |
| CN | 102849587 | A | | 1/2013 | |
| CN | 103233752 | A | | 8/2013 | |
| CN | 203143965 | U | | 8/2013 | |
| CN | 203568650 | U | | 4/2014 | |
| CN | 103935903 | A | | 7/2014 | |
| CN | 105050932 | A | | 11/2015 | |
| CN | 204980977 | U | | 1/2016 | |
| CN | 205527400 | U | | 8/2016 | |
| CN | 205590196 | U | | 9/2016 | |
| CN | 106276624 | A | | 1/2017 | |
| CN | 208992614 | U | * | 6/2019 | B25B 27/02 |
| CN | 213203792 | U | * | 5/2021 | |
| EP | 0057622 | A2 | * | 8/1982 | B66D 3/006 |
| SU | 1079856 | A | | 3/1984 | |
| WO | 2012088654 | A1 | | 7/2012 | |

OTHER PUBLICATIONS

English translation of the Written Opinion of the International Search Authority in the international application No. PCT/CN2017/073733, dated Nov. 15, 2017.

* cited by examiner

VERTICAL LIFTING DEVICE AND METHOD

CROSS-REFERENCE TO RELATED APPLICATIONS

The present application claims priority of China Patent Application No. 201710076913.5, filed on Feb. 13, 2017, the contents of which are hereby incorporated by reference in its entirety.

BACKGROUND

During the digging construction process of a mine, an entire shaft can be dug at one time by utilizing a special drilling technology. However, the internal operation space of the shaft is limited, both rock breaking equipment and auxiliary construction equipment need to be transported into the shaft by means of lifting equipment, and some equipment can operate stably with the need of keeping a lifting rope of the lifting equipment tensioned. Wastes such as gangues in the mine need to be grabbed by a grab bucket, and then be taken away from the shaft by utilizing the lifting equipment. The whole shaft digging process is a synchronous process of an out-shaft lifting system and an in-shaft construction system, and it can be ensured that an underground construction is carried out in order only by mutual coordination.

The conventional in-shaft construction system has been developed into diverse systems including various types of rock drilling machines. However, the out-shaft lifting system always adopts a structure form consisting of a derrick and pulleys. As the derrick needs to be kept away from a wellhead, it is necessary to arrange the supporting columns of the derrick on the ground distant from the outside of the wellhead, a pulley mounting roof of the derrick should have a certain height, and it is also necessary to arrange a winch outside the derrick, so that a large ground area and space will be occupied. Moreover, once the derrick is built completely, the vertical route of the lifting rope of the lifting equipment is fixed and cannot be flexibly adjusted, thereby obstructing the construction of construction equipment inside the shaft. Particularly, during construction of a blind shaft, as the blind shaft is not directly communicated with the ground and the upper space of the shaft is limited, building of the derrick is limited by space, thereby more tends to obstruct the construction of the construction equipment inside the shaft.

A specific structure of a blind shaft and lifting system is as shown in FIG. 1. As shown in FIG. 1, the structure includes a ground 101, a vertical shaft 102, a roadway 103 and a blind shaft 104, wherein a cap shaft 105 is arranged above the blind shaft 104; a hoisting sheave 106 is arranged in the cap shaft 105; a lifting rope starts from a winch 107, passes through a steering pulley 108, bypasses the hoisting sheave 106, and is connected to a weight 109. The winch is mounted away from a main material passage route, thereby avoiding interference to downward transportation of equipment and upward discharge of waste materials. These objective conditions greatly reduce the applicability of a derrick during construction of a blind shaft, such that the underground digging construction efficiency is greatly influenced. Therefore, during practical application, a derrick is not used, a pulley is directly fixed to a shaft wall of a blind shaft, and a steel wire rope descends via a winch to transport equipment downwards or discharge waste materials upwards. However, due to simple and crude facility, not only the efficiency is low, but also the safety is poor.

Therefore, the problems to be urgently solved are that the occupied space of a derrick is large, a vertical route of a lifting rope cannot be adjusted and an entire lifting system is not safe enough.

SUMMARY

The disclosure relates to the technical field of weight lifting, and in particular to a vertical lifting device and method.

In view of this, the embodiments of the disclosure are intended to provide a vertical lifting device and method, being capable of reducing space occupied by the device, flexibly adjusting a vertical route of a lifting rope and increasing the safety of a lifting system.

To this end, the technical solutions in the embodiments of the disclosure are implemented as follows.

The embodiment of the disclosure provides a vertical lifting device, which includes a fixed frame fixed to a foundation, a first cavity allowing passage of a lifting rope is provided in the middle of the fixed frame.

A sliding frame moving horizontally on the fixed frame is arranged above the fixed frame, and a second cavity allowing passage of the lifting rope is provided in the middle of the sliding frame.

At least two stepping vehicles alternately lowering or lifting weights are arranged on the sliding frame and move on the sliding frame. The stepping vehicles are spaced in preset distances. The lifting rope penetrates through the stepping vehicles in sequence. Each stepping vehicle is provided with a clamping part clamping the lifting rope and a driving mechanism driving the stepping vehicle to move on the sliding frame.

In the above solutions, each driving mechanism includes a hydraulic cylinder, a piston rod of each hydraulic cylinder is connected to the corresponding stepping vehicle.

In the above solutions, the vertical lifting device further includes: a control mechanism controlling the driving mechanism to alternately drive each stepping vehicle, the control mechanism is electrically connected to the driving mechanism.

In the above solutions, the control mechanism includes: a sensing part detecting the position of each stepping vehicle, the sensing part is arranged at a preset position facilitating detection of the position of each stepping vehicle, and the sensing part is electrically connected to the control mechanism.

In the above solutions, a first sliding rail allowing movement of the sliding frame is arranged on the fixed frame, first pulleys matched with the first sliding rail are arranged at the bottom of the sliding frame; and a second sliding rail allowing movement of each stepping vehicle is arranged on the sliding frame, second pulleys matched with the second sliding rail are arranged at the bottom of each stepping vehicle.

In the above solutions, the vertical lifting device further includes: a winding reel winding the lifting rope, the winding reel is arranged above or outside the sliding frame, wherein the winding reel can rotate along with the movement of the lifting rope.

In the above solutions, the vertical lifting device further includes a steering pulley, wherein the lifting rope enters the bottom of the steering pulley from each stepping vehicle, bypasses the steering pulley, extends out of the upper part of the steering pulley, and is connected to a weight below via the first cavity and the second cavity.

In the above solutions, the vertical lifting device further includes a braking mechanism for braking of the lifting rope, the lifting rope penetrating through the braking mechanism, and the braking mechanism being arranged between each stepping vehicle and the weight.

The embodiment of the disclosure also provides a vertical lifting method. The method includes the steps as follows.

A first stepping vehicle clamps a lifting rope, a second stepping vehicle unclamps the lifting rope, the first stepping vehicle moves in a first direction, and the second stepping vehicle moves in a second direction.

When the first stepping vehicle moves to an extreme position of the first direction, the second stepping vehicle clamps the lifting rope, the first stepping vehicle unclamps the lifting rope, the second stepping vehicle moves in the first direction, and the first stepping vehicle moves in the second direction.

The first stepping vehicle and the second stepping vehicle alternately clamp the lifting rope to move it in the first direction until a weight reaches a preset position.

In the above solutions, the step that a first stepping vehicle clamps a lifting rope, a second stepping vehicle unclamps the lifting rope, the first stepping vehicle moves in a first direction and the second stepping vehicle moves in a second direction includes the sub-step as follows.

A clamping part of the first stepping vehicle is instructed to clamp the lifting rope and a clamping part of the second stepping vehicle is instructed to unclamp the lifting rope in sequence, a first driving mechanism drives the first stepping vehicle to move in the first direction, and a second driving mechanism drives the second stepping vehicle to move in the second direction.

In the above solutions, the step that when the first stepping vehicle moves to an extreme position of the first direction, the second stepping vehicle clamps the lifting rope, the first stepping vehicle unclamps the lifting rope, the second stepping vehicle moves in the first direction and the first stepping vehicle moves in the second direction includes the sub-steps as follows.

A sensing part is instructed to detect the positions of the stepping vehicles.

When the sensing part senses that the first stepping vehicle has moved to an extreme position of the first direction, a control mechanism is informed.

The clamping part of the second stepping vehicle is instructed to clamp the lifting rope and the clamping part of the first stepping vehicle is instructed to unclamp the lifting rope in sequence, the second driving mechanism drives the second stepping vehicle to move in the first direction, and the first driving mechanism drives the first stepping vehicle to move in the second direction.

In the above solutions, before a first stepping vehicle clamps a lifting rope, a second stepping vehicle unclamps the lifting rope, the first stepping vehicle moves in a first direction, and the second stepping vehicle moves in a second direction, the method further includes the steps as follows.

The position of a sliding frame on a fixed frame is adjusted, such that the position of the lifting rope is adjusted to a preset position.

An initial position of the first stepping vehicle is adjusted to an extreme position of the second direction, and an initial position of the second stepping vehicle is adjusted to an extreme position of the first direction.

The embodiments of the disclosure provide a vertical lifting device and method. The vertical lifting device includes a fixed frame fixed to a foundation. A first cavity allowing passage of a lifting rope is provided in the middle of the fixed frame. A sliding frame moving horizontally on the fixed frame is arranged above the fixed frame. A second cavity allowing passage of the lifting rope is provided in the middle of the sliding frame. At least two stepping vehicles alternately lowering or lifting weights are arranged on the sliding frame and move on the sliding frame. The stepping vehicles are spaced in preset distances. The lifting rope penetrates through the stepping vehicles in sequence. Each stepping vehicle is provided with a clamping part clamping the lifting rope and a driving mechanism driving the stepping vehicle to move on the sliding frame. Obviously, according to the vertical lifting device and method in the embodiments of the disclosure, the vertical position of a lifting rope can be conveniently adjusted by means of mutual coordination of a fixed frame and a sliding frame, and the occupied space of the fixed frame in a height direction is small. At least two stepping vehicles are adopted to alternately lower or lift a weight, such that lowering or lifting of the weight is orderly and quick, and cannot be out of control even under the action of gravitational acceleration, thereby increase the safety of an entire lifting system.

DETAILED DESCRIPTION

Figure 1:
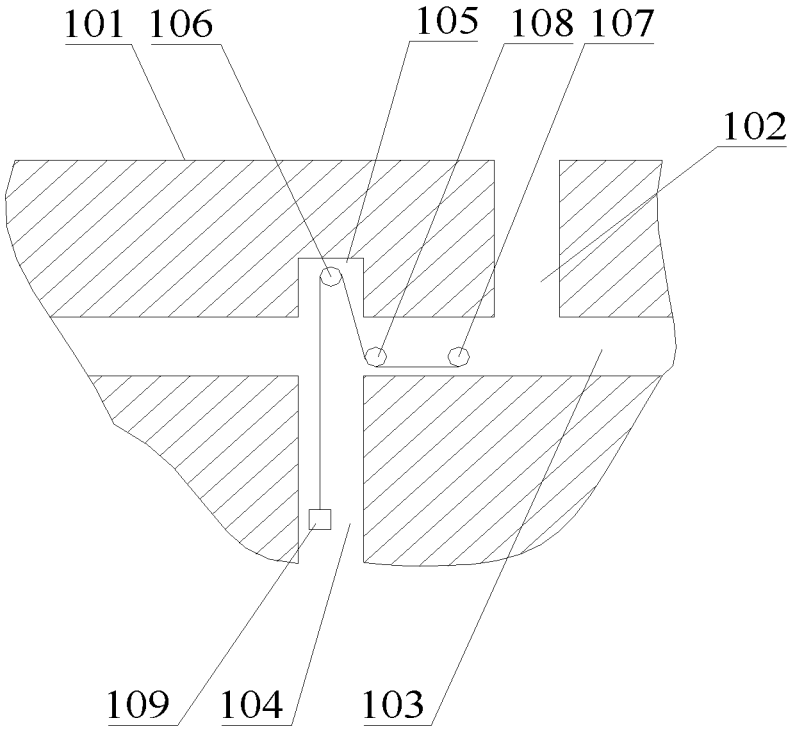
FIG. 1 (PRIOR ART)
FIG. 1 is a structure diagram of a blind shaft and a lifting system in the prior art.

The embodiment of the disclosure provides a vertical lifting device, which includes a fixed frame fixed to a foundation. A first cavity allowing passage of a lifting rope is provided in the middle of the fixed frame. A sliding frame moving horizontally on the fixed frame is arranged above the fixed frame. A second cavity allowing passage of the lifting rope is provided in the middle of the sliding frame. At least two stepping vehicles alternately lowering or lifting weights are arranged on the sliding frame and slide on the sliding frame. The stepping vehicles are spaced in preset distances. The lifting rope penetrates through the stepping vehicles in sequence. Each stepping vehicle is provided with a clamping part clamping the lifting rope and a driving mechanism driving the stepping vehicle to move on the sliding frame.

The principle of the embodiment of the disclosure is: the vertical position of a lifting rope can be conveniently adjusted by means of mutual coordination of a fixed frame and a sliding frame, and the height of the fixed frame is lower than the length or width thereof, thereby the occupied space of the fixed frame in a height direction is small; and at least two stepping vehicles alternately lower or lift a weight, such that lowering or lifting of the weight is orderly and quick, and cannot be out of control even under the action of gravitational acceleration, thereby increasing the safety of an entire lifting system.

In order to know the characteristics and technical contents of the embodiment of the disclosure in detail, a vertical lifting device according to the embodiment of the disclosure is elaborated in detail below.

Specifically, the fixed frame may be rectangular or round, but the height is lower than the length or the width usually, that is, the fixed frame is in a flat shape. So, the occupied space in a height direction is much smaller than a derrick. If a blind shaft is constructed, the height of the fixed frame needs to be smaller than that of a roadway.

The fixed frame is usually fixed to a ground, supporting legs for fixing are arranged at the bottom, and if a blind shaft is constructed, the fixed frame is fixed to the interior of a roadway at a wellhead of the blind shaft.

Further, the supporting legs of the fixed frame may move on the ground or in the roadway of the blind shaft, and may be locked after moving to an appropriate position. Thus, the vertical route of a lifting rope may be adjusted more flexibly.

The supporting legs may be provided with idler wheels facilitating movement on the ground, or may be other structures, which will not be elaborated.

The vertical lifting device may be provided with two stepping vehicles or may be provided with multiple stepping vehicles. As there are more stepping vehicles, the lifting speed of the vertical lifting device is smooth. However, the whole vertical lifting device is complex in structure and likely to be falsely controlled. Preferably, the vertical lifting device is provided with two stepping vehicles.

Each stepping vehicle is provided with a clamping part, which may be powered by pneumatic power, hydraulic power and a motor, no elaboration herein.

A contact part between the clamping part and the lifting rope may be made of a friction material with good friction performance and small abrasion to a lifting rope, particularly a metal-free friction material dominated by inorganic fibers, and more particularly a NO Asbestos Organic (NAO) friction material. Since the lifting rope is a steel wire rope usually, the metal-free friction material makes small abrasion to the steel wire rope, so the service life of the lifting rope is longer.

The vertical lifting device may be provided with a lifting rope or multiple lifting ropes. When there are multiple lifting ropes, each stepping vehicle needs to be accordingly provided with multiple clamping parts or a clamping part having multiple clamping jaws, and it is necessary to avoid mutual friction between the multiple lifting ropes.

Preferably, the vertical lifting device may be provided with two lifting ropes, so that a weight can be balanced, the structure is simple, and the occupied space is small.

Specifically, each driving mechanism includes a hydraulic cylinder, a piston rod of each hydraulic cylinder being connected to the corresponding stepping vehicle. As a movement mode of each stepping vehicle is horizontal reciprocation, the vertical lifting device adopts the hydraulic cylinders as the driving mechanisms, and has the advantages of simple structure, low energy consumption and reliable usage.

Further, the vertical lifting device further includes a control mechanism controlling the driving mechanism to alternately drive the stepping vehicle, the control mechanism being electrically connected to the driving mechanism.

Here, the control mechanism may be a single-chip microcomputer, or may be a Programmable Logic Controller (PLC).

Specifically, the control mechanism includes a sensing part detecting the position of each stepping vehicle, the sensing part being arranged at a preset position facilitating detection of the position of each stepping vehicle, and the sensing part being electrically connected to the control mechanism.

Here, the sensing part may be a travel switch or may be a photoelectric sensor.

Specifically, a first sliding rail allowing movement of the sliding frame is arranged on the fixed frame, first pulleys matched with the first sliding rail being arranged at the bottom of the sliding frame; and a second sliding rail allowing movement of each stepping vehicle is arranged on the sliding frame, second pulleys matched with the second sliding rail being arranged at the bottom of each stepping vehicle.

There are many structures of sliding rails and pulleys, so that the structures of the first sliding rail, the first pulleys, the second sliding rail and the second pulleys are not limited.

Further, the vertical lifting device further includes a winding reel winding the lifting rope, the winding reel being arranged above or outside the sliding frame, wherein the winding reel can rotate along with the movement of the lifting rope.

Here, the winding reel may be not self-powered but only rotates along with the movement of the lifting rope, or may be self-powered such as driven by a motor, and can actively rotate under the instruction of the control mechanism. Specifically, after detecting a movement direction of the lifting rope, the control mechanism sends a corresponding instruction to command a driving mechanism of the winding reel to drive the winding reel to rotate.

As the clamping parts of the stepping vehicles perform alternate clamping during lowering and lifting, the winding reel is basically not stressed as compared to a winding drum of a winch in the prior art, the abrasion of the winding reel and the lifting rope is greatly reduced, thereby prolonging the service life.

Further, the vertical lifting device further includes a steering pulley, wherein the lifting rope enters the bottom of the steering pulley from each stepping vehicle, bypasses the steering pulley, extends out of the upper part of the steering pulley, and is connected to a weight below via the first cavity and the second cavity.

By means of the steering pulley, the abrasion of the lifting rope at a steering position can be avoided, and the vertical route of the lifting rope can be better determined.

Specifically, there may be one or more steering pulleys. Preferably, the vertical lifting device may be provided with two steering pulleys, spaced in a preset distance.

More specifically, the lifting rope enters the bottom of a first steering pulley, passes the first steering pulley, enters the bottom of a second steering pulley, bypasses the second steering pulley, extends out of the upper part of the second steering pulley, enters the upper part of the first steering pulley, and is connected to a weight below via the first cavity and the second cavity.

By means of two steering pulleys, the stress situation of a single steering pulley can be better improved.

Further, in order to avoid mutual friction between a lifting rope in a horizontal direction and a lifting rope in a vertical direction, the lifting rope in the horizontal direction and the lifting rope in the vertical direction can be staggered from each other by adjusting the positions of the steering pulleys; and a flexible isolating part not damaging the lifting ropes may be arranged at a junction between the lifting rope in the horizontal direction and the lifting rope in the vertical direction.

If the lifting rope in the horizontal direction and the lifting rope in the vertical direction are staggered from each other by adjusting the positions of the steering pulleys, the lifting rope will bypass the first steering pulley and directly enter the bottom of the second steering pulley.

Further, the vertical lifting device further includes a braking mechanism for braking of the lifting rope, the lifting rope penetrating through the braking mechanism, and the braking mechanism being arranged between each stepping vehicle and the weight.

Though the lowering speed of the weight cannot be out of control usually by alternate lowering or lifting via the stepping vehicles, the vertical lifting device is provided with the braking mechanism in order to avoid out-of-control lowering or lifting speed of the weight caused by faults such as failure of the clamping parts of the stepping vehicles or disengagement of the lifting rope from the stepping vehicles.

As the out-of-control speed of the lifting device is caused by the gravitational acceleration of the weight usually, the braking mechanism is arranged between each stepping vehicle and the weight, thereby facilitating quick braking.

In the present embodiment, the braking mechanism may be arranged between the stepping vehicle and the steering pulley, that is, the lifting rope penetrates through the stepping vehicle, enters the braking mechanism, and then enters the steering pulley, thereby facilitating quick braking of the braking mechanism and facilitating mounting of the braking mechanism on the sliding frame.

The braking mechanism may be provided with a speed monitoring part and a braking part, wherein the speed monitoring part may be a speed sensor, and the braking part may adopt a friction braking principle.

In the embodiment of the disclosure, clamping of the clamping part of each stepping vehicle during lowering and lifting basically plays a role as a braking part of a winch in the prior art. An independent braking mechanism is additionally arranged, thereby greatly improving the safety of the vertical lifting device.

A contact part between the braking part of the braking mechanism and the lifting rope may be made of the friction material adopted for the clamping parts of the stepping vehicles. Preferably, the contact part between the braking part of the braking mechanism and the lifting rope is made of a NAO friction material.

The speed monitoring part may be electrically connected to the braking mechanism. When the speed monitoring part monitors that the speed of the lifting rope is out of control, the speed monitoring part will inform the braking mechanism, and the braking mechanism informs the braking part to carry out braking.

The speed monitoring part may be arranged at any one place on a movement locus of the lifting rope. Preferably, the speed monitoring part may be arranged at a steering pulley closest to the weight end of the lifting rope, and configured to monitor the movement speed of the lifting rope in the vertical direction. Since the lifting rope is not completely rigid, the speed of each part is not completely consistent, and as long as the speed monitoring part is closest to the weight end of the lifting rope, the movement speed of the weight can be better reflected. The speed monitoring part is located at the steering pulley whilst being closest to the weight end of the lifting rope, so that being convenient to mount and electrically connected to the braking mechanism.

During practical application, the speed monitoring part may be electrically connected to the control mechanism. When the speed monitoring part monitors that the speed of the lifting rope is out of control, the speed monitoring part will inform the control mechanism, and the control mechanism informs the braking mechanism to carry out braking. Thus, it is unnecessary to add a control part to the braking mechanism.

In order to know the characteristics and technical contents of the embodiment of the disclosure in more detail, the disclosure is further elaborated below with the drawings and specific application embodiments. The appended drawings are only used for reference, and not used to limit the embodiment of the disclosure.

Figure 2:
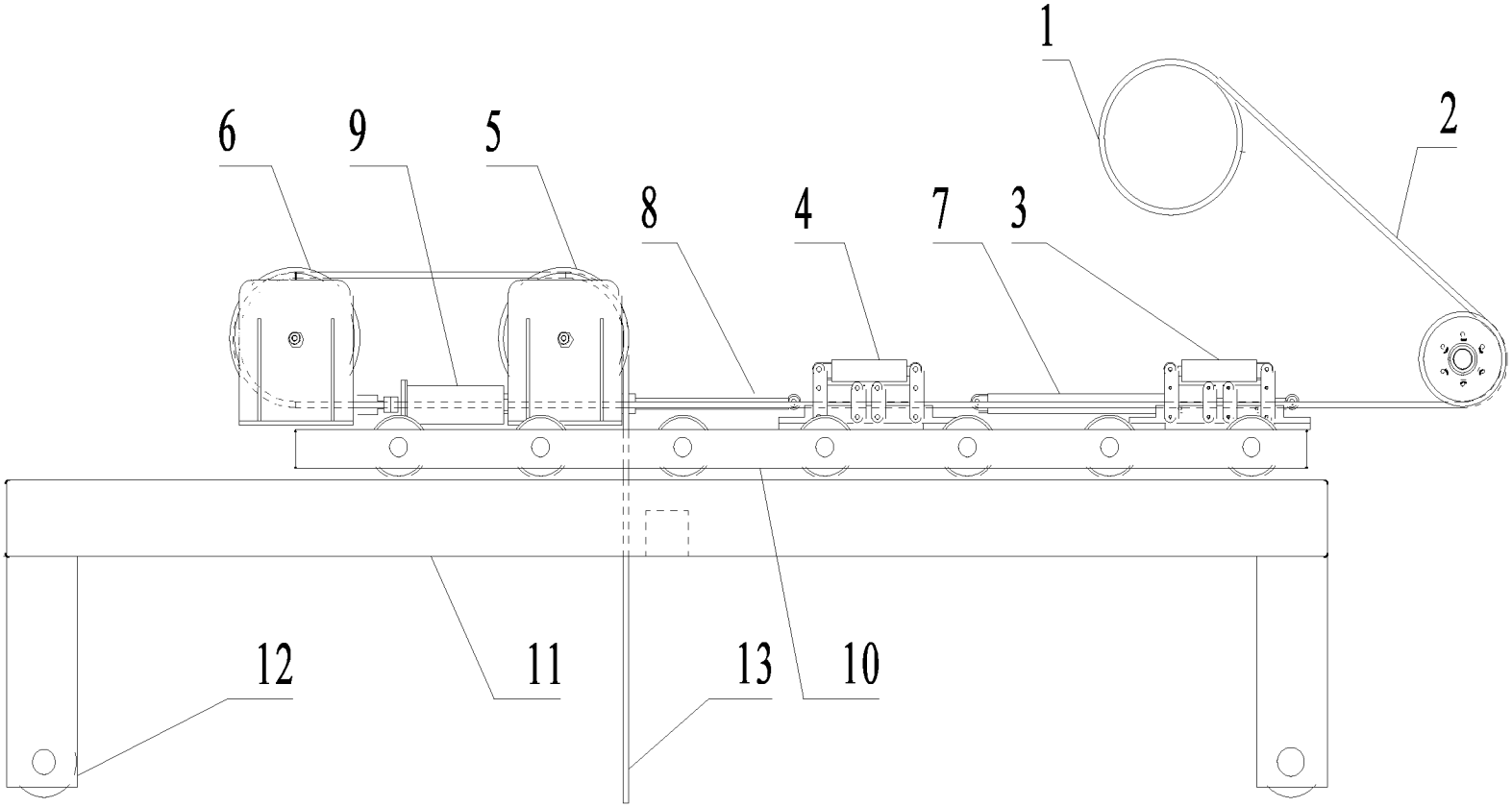
FIG. 2 is a schematic diagram of a vertical lifting device according to an embodiment of the disclosure.
Figure 3:
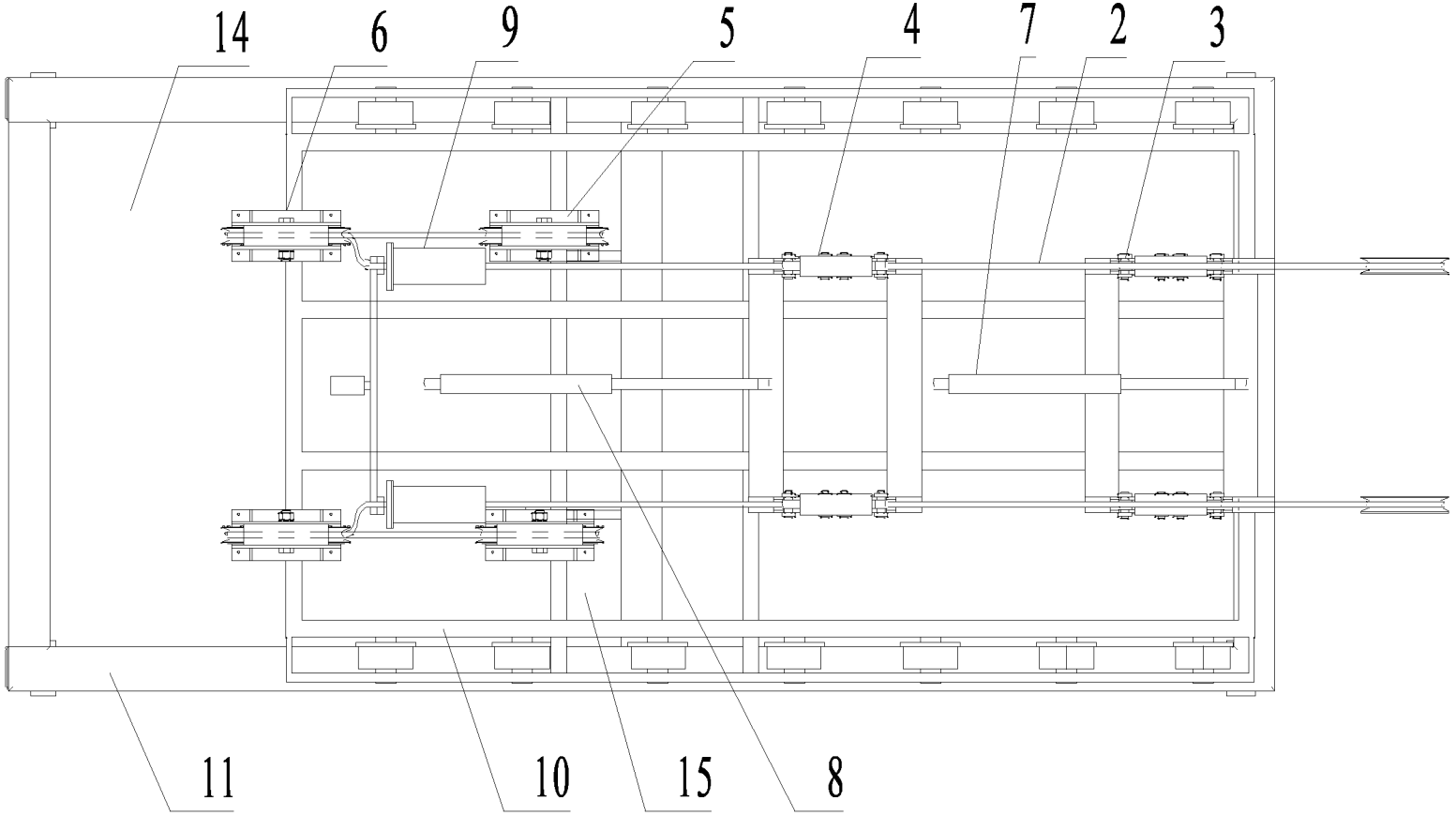
FIG. 3 is a schematic diagram of a top view in FIG. 2.

FIG. 2 is a schematic diagram of a vertical lifting device according to an embodiment of the disclosure. FIG. 3 is a schematic diagram of a top view in FIG. 2. As shown in FIG. 2 and FIG. 3, a vertical lifting device includes a fixed frame 11, a sliding frame 10, lifting ropes 2, a first stepping vehicle 4, a second stepping vehicle 3, a first driving mechanism 8 and a second driving mechanism 7.

The fixed frame 11 is rectangular, supporting legs 12 are arranged on the periphery of the fixed frame, and a first cavity 14 allowing passage of the lifting ropes 2 is provided in the middle of the fixed frame 11. The fixed frame 11 is fixed to the ground via the supporting legs 12, a round idler wheel and a locking device are arranged at the bottom of each supporting leg 12, the round idler wheel may move on the ground, and once moved to an appropriate position, the round idler wheel is locked by the locking device, so the fixed frame 11 is fixed to the ground. If a blind shaft is constructed, the fixed frame is fixed to the interior of a roadway at a wellhead of the blind shaft.

The sliding frame 10 is arranged above the fixed frame 11, the sliding frame 10 can horizontally move on the fixed frame 11, and a second cavity 15 allowing passage of the lifting ropes 2 is provided in the middle of the sliding frame 10.

The first stepping vehicle 4 and the second stepping vehicle 3 are arranged on the sliding frame 10, and the first stepping vehicle 4 and the second stepping vehicle 3 can slide on the sliding frame and are spaced in a preset distance.

In the present embodiment, the vertical lifting device is provided with two lifting ropes 2, connected to either sides of a weight respectively. The lifting ropes 2 penetrate through either sides of the first stepping vehicle 4 and the second stepping vehicle 3 in sequence, penetrate through the first cavity 14 and the second cavity 15, enter the shaft, and are connected to a connecting point 13 of the weight (the weight is not shown in the figures). Either sides of the first stepping vehicle 4 and the second stepping vehicle 3 are provided with a clamping part (not shown in the figures) clamping the lifting ropes. Contact parts between the clamping parts and the lifting ropes 2 are made of NAO friction materials. The first stepping vehicle 4 is provided with the first driving mechanism 8, and the second stepping vehicle 3 is provided with the second driving mechanism 7.

Herein, the first driving mechanism 8 and the second driving mechanism 7 are provided with a hydraulic cylinder separately, a piston rod of the hydraulic cylinder of the first driving mechanism 8 is connected to the first stepping vehicle 4, and a piston rod of the hydraulic cylinder of the second driving mechanism 7 is connected to the second stepping vehicle 3.

Herein, the vertical lifting device further includes a control mechanism controlling the driving mechanisms to alternately drive the first stepping vehicle 4 and the second stepping vehicle 3, the control mechanism is electrically connected to the first driving mechanism 8 and the second driving mechanism 7. The control mechanism is a PLC.

Herein, the control mechanism includes a sensing part (not shown in the figures) sensing the positions of the first stepping vehicle 4 and the second stepping vehicle 3, the sensing part is a travel switch.

Herein, a first sliding rail allowing movement of the sliding frame 10 is arranged on the fixed frame 11, first pulleys matched with the first sliding rail being arranged at the bottom of the sliding frame 10.

A second sliding rail allowing movement of the first stepping vehicle 4 and the second stepping vehicle 3 is arranged on the sliding frame 10, second pulleys matched with the second sliding rail being arranged at the bottoms of the first stepping vehicle 4 and the second stepping vehicle 3 separately.

Herein, the vertical lifting device further includes a winding reel 1 winding the lifting ropes 2, the winding reel 1 being arranged above the sliding frame 10, wherein the winding reel 1 can rotate along with the movement of the lifting ropes 2.

Here, the winding reel 1 is provided with a third driving mechanism (not shown in the figures) driving the winding reel 1 to rotate, when detecting the movement direction of the lifting ropes 2, the control mechanism sends a corresponding instruction to the third driving mechanism, and the third driving mechanism drives the winding reel 1 to rotate.

Herein, the vertical lifting device further includes steering pulleys, namely a first steering pulley 5 and a second steering pulley 6, the two steering pulleys being spaced in a preset distance.

In order to avoid mutual friction between the lifting rope 2 in a horizontal direction and the lifting rope 2 in a vertical direction, the lifting rope 2 in the horizontal direction and the lifting rope 2 in the vertical direction are staggered from each other by adjusting the positions of the steering pulleys. As shown in FIG. 3, the first steering pulley 5 and the second steering pulley 6 are shifted to the outside of the sliding frame 10 by a certain distance, such that the lifting rope 2 in the horizontal direction and the lifting rope 2 in the vertical direction can be staggered from each other.

Herein, the vertical lifting device further includes a braking mechanism 9 for braking of the lifting ropes 2, the lifting ropes 2 penetrate through the braking mechanism 9, and the braking mechanism 9 being arranged between the first stepping vehicle 4 and the steering pulley.

Here, the braking mechanism 9 adopts a friction braking principle, and the braking mechanism 9 executes a braking action under the instruction of the control mechanism.

Contact parts between a braking part of the braking mechanism and the lifting ropes 2 are made of NAO friction materials, and the lifting ropes 2 are steel wire ropes usually, so the NAO friction materials cause small abrasion to the lifting ropes 2.

Herein, the vertical lifting device is further provided with a speed monitoring part. The speed monitoring part is electrically connected to the control mechanism. When the speed monitoring part monitors that the speed of the lifting ropes 2 is out of control, the speed monitoring part will inform the control mechanism, and the control mechanism informs the braking mechanism 9 to carry out braking.

The speed monitoring part is arranged at the first steering pulley 5, and configured to monitor the movement speed of the lifting rope in the vertical direction.

The embodiment of the disclosure further provides a vertical lifting method. Since weight lowering and weight lifting are involved, there are two flows namely a weight lowering flow and a weight lifting flow, which will be introduced below respectively.

Figure 4:
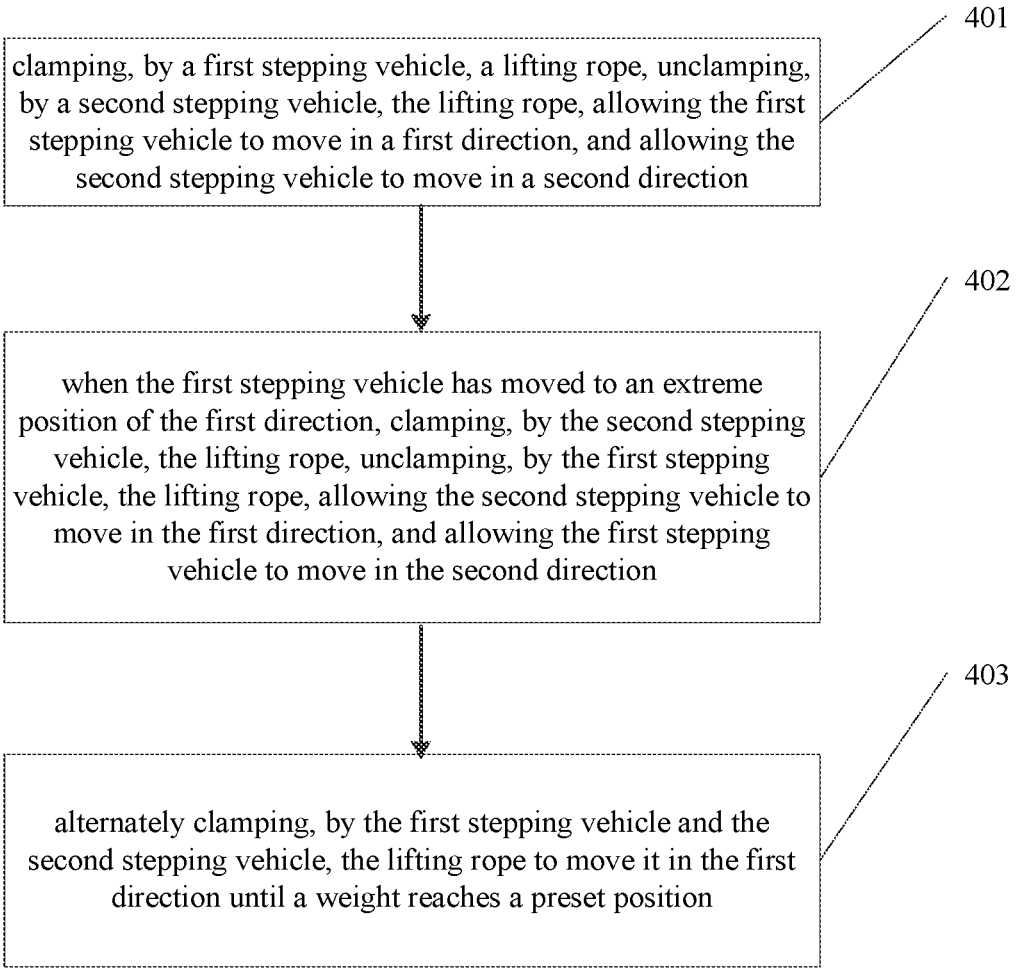
FIG. 4 is a flowchart of weight lowering in a vertical lifting method according to an embodiment of the disclosure.

FIG. 4 is a flowchart of weight lowering in a vertical lifting method according to an embodiment of the disclosure. FIG. 2 is a schematic diagram of a vertical lifting device according to an embodiment of the disclosure. FIG. 3 is a schematic diagram of a top view in FIG. 2. The weight lowering flow in the vertical lifting method according to the embodiment of the disclosure will be elaborated below with FIG. 2 to FIG. 4 in detail. As shown in FIG. 2 to FIG. 4, the flow includes the steps as follows.

Step 401, in which a first stepping vehicle clamps a lifting rope, a second stepping vehicle unclamps the lifting rope, the first stepping vehicle moves in a first direction, and the second stepping vehicle moves in a second direction.

Here, the first direction is a direction close to a weight, namely a left side in FIG. 2 or FIG. 3, and the second direction is a direction away from the weight, namely a right side in FIG. 2 or FIG. 3.

Specifically, a control mechanism instructs a clamping part of the first stepping vehicle 4 to clamp the lifting rope 2 and instructs a clamping part of the second stepping vehicle 3 to unclamp the lifting rope 2, a first driving mechanism 8 drives the first stepping vehicle 4 to move in the first direction, and a second driving mechanism 7 drives the second stepping vehicle 3 to move in the second direction.

Step 402, in which when the first stepping vehicle moves to an extreme position of the first direction, the second stepping vehicle clamps the lifting rope, the first stepping vehicle unclamps the lifting rope, the second stepping vehicle moves in the first direction, and the first stepping vehicle moves in the second direction.

Specifically, the control mechanism instructs a sensing part to detect the positions of the stepping vehicles.

When the sensing part senses that the first stepping vehicle 4 moves to the extreme position of the first direction, the control mechanism is informed.

The control mechanism instructs the clamping part of the second stepping vehicle 3 to clamp the lifting rope 2 and instructs the clamping part of the first stepping vehicle 4 to unclamp the lifting rope 2, the second driving mechanism 7 drives the second stepping vehicle 3 to move in the first direction, and the first driving mechanism 8 drives the first stepping vehicle 4 to move in the second direction.

Step 403, in which the first stepping vehicle and the second stepping vehicle alternately clamp the lifting rope to move it in the first direction until a weight reaches a preset position.

With the presence of gravitational acceleration during weight lowering or lifting, a control mechanism instructs two stepping vehicles to alternately lower or lift a weight, such that the lowering or lifting of the weight is more orderly, thereby it is avoided from being out of control even under the action of the gravitational acceleration, and increase the safety of an entire lifting system.

The first stepping vehicle 4 and the second stepping vehicle 3 only make a straight reciprocating motion. Therefore, when one of the stepping vehicles is moving with the lifting rope 2 clamped, the other stepping vehicle needs to move in the opposite direction, in order to reserve a travel for the next movement with the lifting rope 2 clamped.

Figure 5:
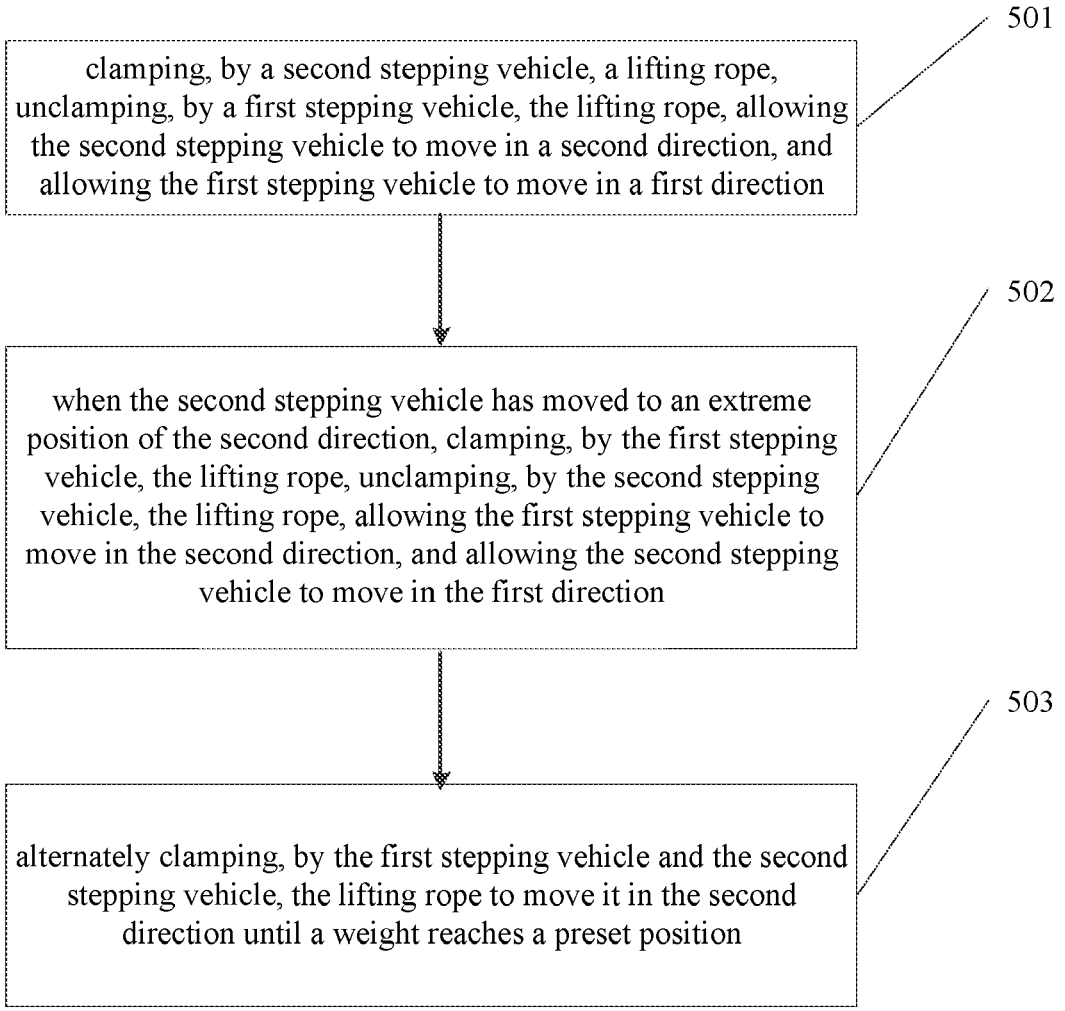
FIG. 5 is a flowchart of weight lifting in a vertical lifting method according to an embodiment of the disclosure.

FIG. 5 is a flowchart of weight lifting in a vertical lifting method according to an embodiment of the disclosure. FIG. 2 is a schematic diagram of a vertical lifting device according to an embodiment of the disclosure. FIG. 3 is a schematic diagram of a top view in FIG. 2. The weight lowering flow in the vertical lifting method according to the embodiment of the disclosure will be elaborated below with FIG. 2, FIG. 3 and FIG. 5 in detail. As shown in FIG. 2, FIG. 3 and FIG. 5, the flow includes the steps as follows.

Step 501, in which a second stepping vehicle clamps a lifting rope, a first stepping vehicle unclamps the lifting rope, the second stepping vehicle moves in a second direction, and the first stepping vehicle moves in a first direction.

Here, the first direction is a direction close to a weight, namely a left side in FIG. 2 or FIG. 3, and the second direction is a direction away from the weight, namely a right side in FIG. 2 or FIG. 3.

Specifically, a control mechanism instructs a clamping part of the second stepping vehicle 3 to clamp the lifting rope 2 and instructs a clamping part of the first stepping vehicle 4 to unclamp the lifting rope 2, a second driving mechanism 7 drives the second stepping vehicle 3 to move in the second direction, and a first driving mechanism 8 drives the first stepping vehicle 4 to move in the first direction.

Step 502, in which when the second stepping vehicle moves to an extreme position of the second direction, the first stepping vehicle clamps the lifting rope, the second stepping vehicle unclamps the lifting rope, the first stepping vehicle moves in the second direction, and the second stepping vehicle moves in the first direction.

Specifically, the control mechanism instructs a sensing part to detect the positions of the stepping vehicles.

When the sensing part senses that the second stepping vehicle 3 moves to the extreme position of the second direction, the control mechanism is informed.

The control mechanism instructs the clamping part of the first stepping vehicle 4 to clamp the lifting rope 2 and instructs the clamping part of the second stepping vehicle 3 to unclamp the lifting rope 2, the first driving mechanism 8 drives the first stepping vehicle 4 to move in the second direction, and the second driving mechanism 7 drives the second stepping vehicle 3 to move in the first direction.

Step 503, in which the first stepping vehicle and the second stepping vehicle alternately clamp the lifting rope to move it in the second direction until a weight reaches a preset position.

With the presence of gravitational acceleration during weight lowering or lifting, a control mechanism instructs two stepping vehicles to alternately lower or lift a weight, such that the lowering or lifting of the weight is more orderly, thereby it is avoided from being out of control even under the action of the gravitational acceleration, and increase the safety of an entire lifting system.

The first stepping vehicle 4 and the second stepping vehicle 3 only make a straight reciprocating motion. Therefore, when one of the stepping vehicles is moving with the lifting rope 2 clamped, the other stepping vehicle needs to move in the opposite direction, in order to reserve a travel for the next movement with the lifting rope 2 clamped.

The above is only the preferred embodiments of the disclosure, and not intended to limit the scope of protection of the disclosure. Any modifications, equivalent replacements, improvements and the like made within the spirit and principle of the disclosure shall fall within the scope of protection of the disclosure.

According to the vertical lifting device and method in the embodiments of the disclosure, the vertical position of a lifting rope can be conveniently adjusted by means of mutual coordination of a fixed frame and a sliding frame, and the occupied space of the fixed frame in a height direction is small. At least two stepping vehicles are adopted to alternately lower or lift a weight, such that lowering or lifting of the weight is orderly and quick, and cannot be out of control even under the action of gravitational acceleration, thereby increase the safety of an entire lifting system.

The invention claimed is:

1. A vertical lifting device, comprising a fixed frame fixed to a foundation, a first cavity allowing passage of a lifting rope is provided in a middle of the fixed frame, wherein a sliding frame moving horizontally on the fixed frame is arranged above the fixed frame, a second cavity allowing passage of the lifting rope is provided in a middle of the sliding frame; and at least two stepping vehicles alternately lowering or lifting weights are arranged on the sliding frame and move on the sliding frame, the stepping vehicles are spaced in preset distances, the lifting rope penetrates through the stepping vehicles in sequence, and each stepping vehicle is provided with a clamping part clamping the lifting rope and a driving mechanism driving the stepping vehicle to move on the sliding frame;

wherein the at least two stepping vehicles at least comprise a first stepping vehicle and a second stepping vehicle.

2. The vertical lifting device according to claim 1, wherein the driving mechanism comprises a hydraulic cylinder, a piston rod of each hydraulic cylinder is connected to the corresponding stepping vehicle.

3. The vertical lifting device according to claim 2, further comprising: a control mechanism controlling the driving mechanism to alternately drive each stepping vehicle, wherein the control mechanism is electrically connected to the driving mechanism.

4. The vertical lifting device according to claim 2, wherein a first sliding rail allowing movement of the sliding frame is arranged on the fixed frame, first pulleys matched with the first sliding rail are arranged at a bottom of the sliding frame; and a second sliding rail allowing movement of each stepping vehicle is arranged on the sliding frame, second pulleys matched with the second sliding rail are arranged at a bottom of each stepping vehicle.

5. The vertical lifting device according to claim 2, further comprising: a winding reel winding the lifting rope, the winding reel is arranged above or outside the sliding frame, the winding reel can rotate along with the movement of the lifting rope.

6. The vertical lifting device according to claim 2, further comprising a steering pulley, the lifting rope enters a bottom of the steering pulley from each stepping vehicle, bypasses the steering pulley, then extends out of an upper part of the steering pulley, and is connected to a weight below via the first cavity and the second cavity.

7. The vertical lifting device according to claim 2, further comprising a braking mechanism for braking of the lifting rope, the lifting rope penetrates through the braking mechanism, and the braking mechanism being arranged between each stepping vehicle and the weight.

8. The vertical lifting device according to claim 1, further comprising: a control mechanism controlling the driving mechanism to alternately drive each stepping vehicle, the control mechanism is electrically connected to the driving mechanism.

9. The vertical lifting device according to claim 8, wherein the control mechanism comprises: a sensing part detecting a position of each stepping vehicle, the sensing part being arranged at a preset position facilitating detection of the position of each stepping vehicle, and the sensing part is electrically connected to the control mechanism.

10. The vertical lifting device according to claim 1, wherein a first sliding rail allowing movement of the sliding frame is arranged on the fixed frame, first pulleys matched with the first sliding rail are arranged at a bottom of the sliding frame; and a second sliding rail allowing movement of each stepping vehicle is arranged on the sliding frame, second pulleys matched with the second sliding rail are arranged at a bottom of each stepping vehicle.

11. The vertical lifting device according to claim 1, further comprising: a winding reel winding the lifting rope, the winding reel is arranged above or outside the sliding frame, the winding reel can rotate along with the movement of the lifting rope.

12. The vertical lifting device according to claim 1, further comprising a steering pulley, the lifting rope enters a bottom of the steering pulley from each stepping vehicle, bypasses the steering pulley, then extends out of an upper part of the steering pulley, and is connected to a weight below via the first cavity and the second cavity.

13. The vertical lifting device according to claim 1, further comprising a braking mechanism for braking of the lifting rope, the lifting rope penetrates through the braking mechanism, and the braking mechanism being arranged between each stepping vehicle and the weight.

14. A vertical lifting method performed by the vertical lifting device according to claim 1, comprising:

clamping, by a first stepping vehicle, a lifting rope, unclamping, by a second stepping vehicle, the lifting rope, allowing the first stepping vehicle to move in a first direction, and allowing the second stepping vehicle to move in a second direction;

when the first stepping vehicle has moved to an extreme position of the first direction, clamping, by the second stepping vehicle, the lifting rope, unclamping, by the first stepping vehicle, the lifting rope, allowing the second stepping vehicle to move in the first direction, and allowing the first stepping vehicle to move in the second direction; and alternately clamping, by the first stepping vehicle and the second stepping vehicle, the lifting rope to move it in the first direction until a weight reaches a preset position.

15. The method according to claim 14, wherein the step of clamping, by the first stepping vehicle, the lifting rope, unclamping, by the second stepping vehicle, the lifting rope, allowing the first stepping vehicle to move in the first direction and allowing the second stepping vehicle to move in the second direction comprises:

instructing a clamping part of the first stepping vehicle to clamp the lifting rope and instructing a clamping part of the second stepping vehicle to unclamp the lifting rope in sequence, driving, by a first driving mechanism, the first stepping vehicle to move in the first direction, and driving, by a second driving mechanism, the second stepping vehicle to move in the second direction.

16. The method according to claim 14, wherein the step of when the first stepping vehicle has moved to the extreme position of the first direction, clamping, by the second stepping vehicle, the lifting rope, unclamping, by the first stepping vehicle, the lifting rope, allowing the second stepping vehicle to move in the first direction and allowing the first stepping vehicle to move in the second direction comprises:

instructing a sensing part to detect the positions of the stepping vehicles;

when the sensing part senses that the first stepping vehicle has moved to the extreme position of the first direction, informing a control mechanism; and instructing a clamping part of the second stepping vehicle to clamp the lifting rope and instructing the clamping part of the first stepping vehicle to unclamp the lifting rope in sequence, driving, by the second driving mechanism, the second stepping vehicle to move in the first direction, and driving, by the first driving mechanism, the first stepping vehicle to move in the second direction.

17. The method according to claim 14, wherein before the step of clamping, by the first stepping vehicle, the lifting rope, unclamping, by the second stepping vehicle, the lifting rope, allowing the first stepping vehicle to move in the first direction and allowing the second stepping vehicle to move in the second direction, the method further comprises:

adjusting a position of a sliding frame on a fixed frame such that a position of the lifting rope is adjusted to a preset position; and adjusting an initial position of the first stepping vehicle to an extreme position of the second direction, and adjusting an initial position of the second stepping vehicle to the extreme position of the first direction.

18. The method according to claim 15, wherein the step of when the first stepping vehicle has moved to the extreme position of the first direction, clamping, by the second stepping vehicle, the lifting rope, unclamping, by the first stepping vehicle, the lifting rope, allowing the second stepping vehicle to move in the first direction and allowing the first stepping vehicle to move in the second direction comprises:

instructing a sensing part to detect positions of the stepping vehicles;

when the sensing part senses that the first stepping vehicle has moved to the extreme position of the first direction, informing a control mechanism; and instructing the clamping part of the second stepping vehicle to clamp the lifting rope and instructing the clamping part of the first stepping vehicle to unclamp the lifting rope in sequence, driving, by the second driving mechanism, the second stepping vehicle to move in the first direction, and driving, by the first driving mechanism, the first stepping vehicle to move in the second direction.

19. The method according to claim 15, wherein before the step of clamping, by the first stepping vehicle, the lifting rope, unclamping, by the second stepping vehicle, the lifting rope, allowing the first stepping vehicle to move in the first direction and allowing the second stepping vehicle to move in the second direction, the method further comprises:

adjusting a position of a sliding frame on a fixed frame such that a position of the lifting rope is adjusted to a preset position; and adjusting an initial position of the first stepping vehicle to an extreme position of the second direction, and adjusting an initial position of the second stepping vehicle to the extreme position of the first direction.

* * * * *